US006328110B1

(12) United States Patent
Joubert

(10) Patent No.: US 6,328,110 B1
(45) Date of Patent: Dec. 11, 2001

(54) PROCESS FOR DESTROYING A RIGID THERMAL INSULATOR POSITIONED IN A CONFINED SPACE

(75) Inventor: Philippe Joubert, Lyons (FR)

(73) Assignee: Elf Exploration Production (FR)

( * ) Notice: Subject to any disclaimer, the term of this patent is extended or adjusted under 35 U.S.C. 154(b) by 0 days.

(21) Appl. No.: 09/488,077

(22) Filed: Jan. 20, 2000

(30) Foreign Application Priority Data

Jan. 20, 1999 (FR) ..... 99 00584

(51) Int. Cl.[7] ..... E21B 36/00

(52) U.S. Cl. ..... 166/376; 166/57; 166/303; 166/901

(58) Field of Search ..... 166/303, 302, 166/376, 57, 901, 272.1, 90.1

(56) References Cited

U.S. PATENT DOCUMENTS 3,613,792 * 10/1971 Hyde et al. ..... 166/315
3,880,236 * 4/1975 Durning et al. ..... 166/302
4,296,814 10/1981 Stalder et al. ..... 166/303
5,271,466 12/1993 Harms ..... 166/300
5,858,489 1/1999 Beauquin ..... 428/36.5

FOREIGN PATENT DOCUMENTS

916049 * 12/1972 (CA) .

* cited by examiner

*Primary Examiner*—David Bagnell
*Assistant Examiner*—Zakiya Walker
(74) *Attorney, Agent, or Firm*—Blank Rome Comisky & McCauley, LLP

(57) ABSTRACT

Process for destroying a rigid thermal insulator obtained in particular by a process of the sol-gel type and positioned in a confined space, the process comprising the stage of introducing a dissolving liquid into the confined space in order to convert the insulator into a liquid phase. The process applies in particular to destroying an insulating jacket positioned in the annular space of an oil well.

14 Claims, 1 Drawing Sheet

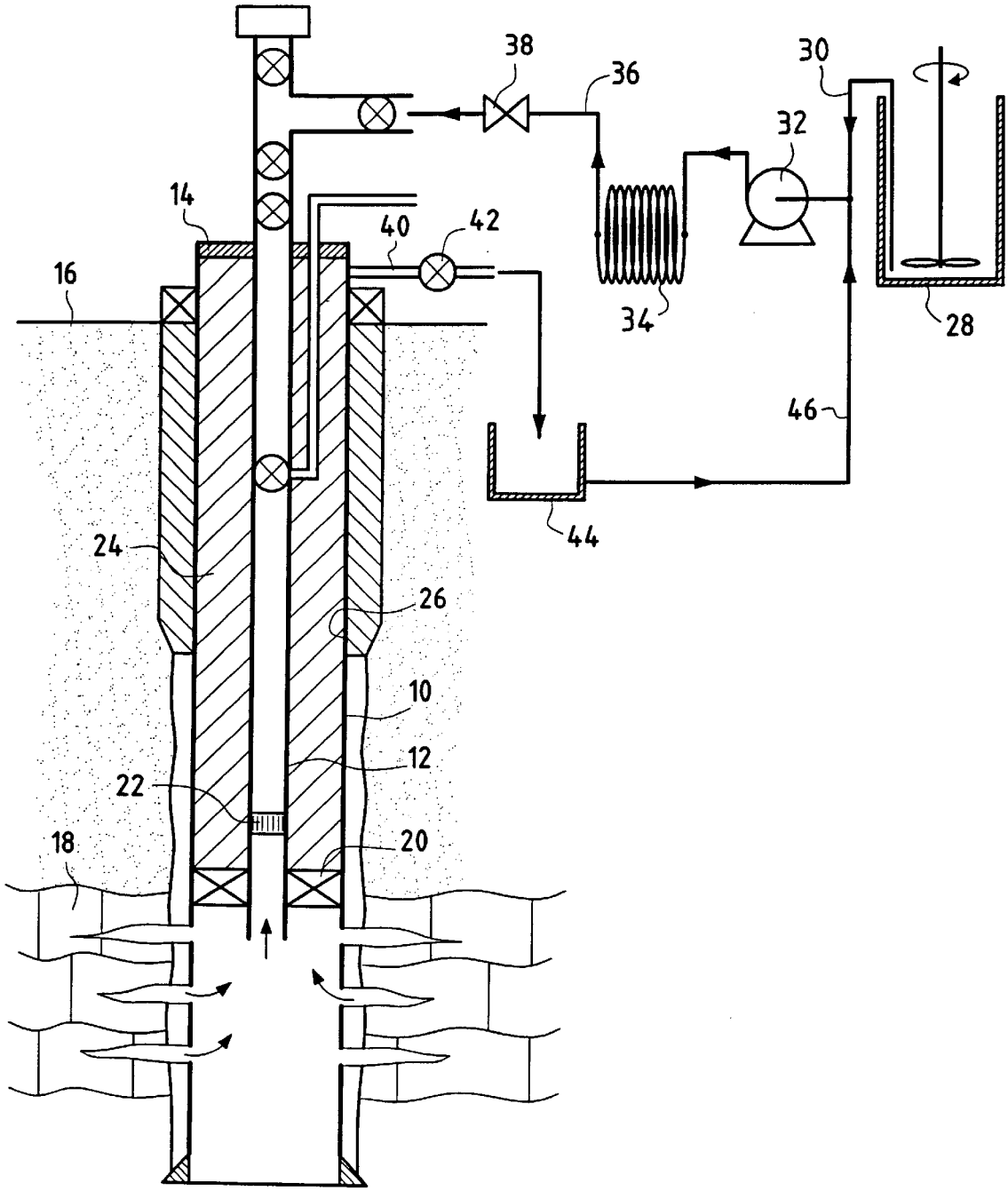
38
36
30
32
14
40
42
16
34
28
46
44
24
26
10
12
22
20
18

PROCESS FOR DESTROYING A RIGID THERMAL INSULATOR POSITIONED IN A CONFINED SPACE

BACKGROUND OF THE INVENTION

1. Field of the Invention

The present invention relates to a process for destroying a rigid thermal insulator and more particularly such a rigid insulator installed around a pipe in a confined space, for example an oil well.

2. Description of Related Art

During the bringing in of an oil deposit, hydrocarbons flow in the pipe, known as the production string, from the bottom of the well to the surface. At the bottom of the well, the pressure and the temperature are relatively high, for example 100° C. and 300 bar. As the hydrocarbons rise towards the surface, this pressure and this temperature decrease, with the result that the temperature at the outlet of the well is, for example, of the order of 30° C.

This fall in temperature of the hydrocarbons in the production string has the effect of increasing the viscosity and the weight of these hydrocarbons, which can lead to a slowdown in their flow. Furthermore, the fall in temperature can sometimes cause the deposition, on the wall of the string, of paraffin hydrates or of liquid vesicles, for example water. If it accumulates in the pipe, this deposit can lead to serious operating problems, such as the slowdown of the hydrocarbons, indeed the complete blockage of the pipe. Generally, if it is desired to avoid these risks, the operator is obliged to treat this deposition phenomenon, either preventively, by injection of a chemical which inhibits the deposition, or curatively, by scraping or wiping the pipe with special equipment or alternatively by reheating it with an optionally available means. In all cases, these operations constitute a significant financial expenditure. This type of problem also exists in pipes which connect a wellhead to a distant processing centre.

The installation of thermal insulation around a production string or pipe, optionally coupled to an electrical heating system or other system, makes it possible to maintain the temperature of these flows during their journey at a high value, thus reducing depositions on the wall of the string and other problems associated with the temperature.

French Patent Application No. 9801009 discloses a process for the preparation of a mixture which can be injected and gelled in situ in a confined space, for example the annular space of an oil well, starting with a precursor to be gelled, which may or may not comprise solid particles, with a dilution solvent and with a gelling catalyst. This process comprises a first stage in which the dilution solvent and the gelling catalyst are mixed together and a second stage in which the resulting solution is mixed with the precursor to be gelled, the mixture thus obtained being injected into the confined space. According to the invention, each of the first or second stages is carried out in a static mixer. This process makes it possible, for example, to install an insulating jacket formed of organogel in situ in the annular space of an oil well.

The confined space can also comprise a thermal insulator composed of aerogel or xerogel powder synthesized ex situ and introduced into the confined space, for example by means of a metering screw for pulverulent products. It can also comprise aerogels synthesized in situ, as disclosed in the document FR 9513601.

Once a rigid insulating jacket has been positioned in the annular space of a well, it may happen that it is necessary either to modify the insulating characteristics of the jacket as a function of the change in conditions in the well or to carry out a maintenance operation on the well or to remove the production string from the well. The presence of a rigid insulating jacket in the annular space of the well makes this type of operation difficult, indeed even impossible.

In order to be able to carry out such operations on a well, it is necessary to remove the rigid insulating jacket beforehand.

SUMMARY OF THE INVENTION

A subject-matter of the present invention is therefore a process for destroying a rigid insulator positioned in a confined space which is simple and effective and which ensures that the insulator can be completely removed from the space which it has filled.

To meet this objective, the invention provides a process for destroying a rigid insulator obtained by a process of the sol-gel type and positioned in a confined space, the process comprising the stage of introducing a dissolving basic liquid into the confined space in order to convert the insulator to a liquid phase.

The present invention makes it possible more particularly to destroy rigid insulators formed of organogel or of aerogel by replacing a rigid phase by a liquid phase which is not very viscous. A specific application of the invention relates to the destruction of a thermal insulator present in the annular space of a well for the production of hydrocarbons.

The characteristics and advantages of the present invention will become more clearly apparent on reading the following description, made with regard to the appended drawings, in which drawings the single FIGURE is a diagrammatic view of a plant allowing the implementation of the process for destroying a rigid insulator according to the invention.

BRIEF DESCRIPTION OF THE FIGURE OF DRAWING

The FIGURE of drawing is a cross-sectional diagrammatic view of an oil well provided with a rigid thermal insulator installed around a pipe according to the invention.

DETAILED DESCRIPTION OF THE PREFERRED EMBODIMENT

As represented in the FIGURE, an oil well 10 comprises a production string 12 extending between a wellhead 14, situated at the surface of the ground 16 or possibly on an offshore platform, and a stratum of oil-bearing rock 18. Towards its lower end, at a point slightly above a seal 20 positioned in the well 10, the production string comprises a device 22 allowing the circulation of fluids. An annular space 24 defined between a casing 26, which forms the wall of the well, and the production string 12 is delimited by the wellhead 14 and the seal 20. This annular space is filled with a rigid insulator obtained, for example, by a process of the sol-gel type.

The rigid insulator positioned in the annular space 24 can be formed of an organogel, of an aerogel or of a xerogel. It is convenient to recall here that the term "aerogel" is understood to mean a microporous solid, the preparation of which in the powder or non-powder form generally comprises a stage of supercritical drying, and the term "organogel" is understood to mean, for example, all the materials resulting from synthesis of the sol-gel type starting with organo-metallic precursors but which are undried. The term "xerogel" denotes porous solids resulting from a sol-gel process but dried without resorting to a supercritical process.

The rigid insulator positioned in the annular space 24 serves to prevent the fall in temperature which takes place when the flows rise from the stratum of oil-bearing rock 18 to the surface. Typically, without insulator, the flows change from a temperature of 150° at a depth of 3000 m to a temperature of approximately 30° at the outlet 28. This fall in temperature leads to depositions of paraffins and of other compounds on the wall of the production string 12.

During the production phase of the well, it may be necessary to modify the characteristics of the insulator in order to take into account the change in the thermal conditions in the well. It may also be necessary to carry out a maintenance operation on the well or, in the event of wear or of mechanical failure, to remove the production string from the well in order to replace it. Before being able to carry out such operations on the well, it is necessary to remove the rigid insulator positioned in the annular space.

In order to be able to remove the rigid insulator from the annular space, it is firstly necessary to destroy it by converting it to a liquid phase which is not very viscous or to a suspension of low viscosity. To do this, a plant comprising a tank 28, which tank is intended to comprise a dissolving basic liquid, is positioned at the surface of the ground 16 beside the wellhead 14. The term "dissolving basic liquid" is generally understood to mean NaOH solutions but it is also possible to use solutions of KOH, of ammonia ($NH_4OH$) and, to a lesser extent, solutions or suspensions of alkaline earth hydroxides ($Ca(OH)_2$ or $Mg(OH)_2$). A pipe 30, in which is installed a pump 32, leads from the tank 28 to a heat exchanger, represented generally by 34, intended to heat the dissolving liquid. From the heat exchanger 34, a pipe 36, equipped with a control valve 38, opens, across the wellhead 14, into the production string 12. The dissolving liquid fills the interior of the production string and then passes through the device 22 into the annular space 24. The liquid mixture exiting from the annular space passes through a pipe 40, equipped with a valve 42, to a storage tank 44. In order to be able to minimize losses in the flow, a pipe 46 makes it possible to recycle the liquid at a point upstream of the pump 32.

This plant makes it possible, according to the process of the invention, to introduce, into the annular space, liquid originating from the tank 28 and to recover the liquid mixture resulting from the destruction of the rigid insulator present in the annular space.

The invention is illustrated by following examples given without implied limitation.

EXAMPLE 1

In this example, the volume filled with thermal insulator to be destroyed is composed of an annular space composed of an outer cylindrical pipe with an internal diameter of 150 mm in the vertical position, itself concentrically comprising a pipe with an external diameter of 70 mm, the entire assembly having a height of 1.2 m. The annular space delimited by these two pipes had been filled with a mixture which has gelled in situ. The space had been filled in the following way: a first mixture, composed of 7.2 kg of ethanol to which are added, with stirring, 100 g of 48 mass % aqueous hydrofluoric acid solution, is prepared in a first vessel. This homogeneous solution is transferred into a second stirred vessel comprising, beforehand, 8.3 kg of polyethoxysilane Hydrosil(Aste)® from the company PCAS. The new mixture thus prepared is then introduced by pumping into the said annular space. Complete gelling was obtained after 48 hours.

The operation of destroying the thermal insulator present in the annular space, carried out two months after its manufacture, consists in:

firstly, percolating water from the bottom upwards in the annular space at the rate of 200 l/h in order to extract as much as possible of alcoholic phase in 15 minutes, secondly, injecting, by means of a pump, a 4 mol per liter sodium hydroxide solution from a tank comprising 18 liters of sodium hydroxide solution. This solution passes through a heat exchanger at 40° C. before entering the annular space from the bottom upwards at the rate of 210 l/h. The effluent liquid at the top of the annular space is returned to the sodium hydroxide tank, thus establishing a circuit. After continuously percolating for 2 hours with recycling, the rigid insulator present in the annular space is completely removed and the space only comprises a basic brine. The latter is then replaced with raw water. At the end of the operation, the starting rigid insulator has been substituted by process water.

EXAMPLE 2

In this example, the annular space described in Example 1 was filled with silica aerogel powder over a height of 0.7 meter. This powder had been prepared via a sol-gel process and by drying with supercritical $CO_2$. This rigid insulator was destroyed in the following way: 9 liters of a 4 mol/l sodium hydroxide solution were injected by pumping through a heat exchanger at 45° C. into the top part of the annular space. Once the sodium hydroxide was in place, the assembly was left for 18 hours. At the end of this period of time, solid was found to be absent from the annular space, the solid having been completely dissolved, giving way to a basic brine. As in Example 1, the latter was replaced with process water. At the end of the operation, the starting rigid insulator has been substituted by process water.

EXAMPLE 3

In this example, the volume filled with thermal insulator to be destroyed is composed of an annular space situated between a vertical outer pipe with an internal diameter of 6"⅝ (168 mm) and a concentric inner pipe with an external diameter of 3"½ (88.9 mm), the entire assembly having a length of 10 m. A silica aerogel monolith charged with acetylene black (carbon black) was synthesized beforehand in situ in this annular space. The operation of destroying the thermal insulator was carried out in the way described below. 1 $m^3$/h of sodium hydroxide solution is withdrawn, by means of a pump 32, from a 500 l tank 28 comprising 300 l of sodium hydroxide solution (4 mol/l NaOH) and is passed through a heat exchanger at 60° C., is then passed from the top downwards in the pipe 12 and is raised in the annular space 24 after having passed through the valve 22 in order to emerge at the top of the annular space and finally to return to the tank 28. A closed loop circulation of the sodium hydroxide solution was thus established for 4 hours. At the end of this period of time, no more solid remains to be dissolved in the annular space. Rinsing/washing of this space is carried out by passing through 5 $m^3$ of process water which is not recycled. At the end of the operation, the starting rigid insulator has been destroyed and substituted by process water, thus removing the final traces of carbon black.

Before injecting the dissolving liquid into the well, it is possible, in an additional prewash stage, to inject water beforehand. It is also possible to position a filter in the pipe 40 upstream of the storage tank 44 or optionally a mill intended to destroy large aerogel pieces exiting from the well.

In the case of a well which has not been equipped with a circulating valve at the bottom, it is possible to install thermal insulation in the annular space on the basis of a silica organogel without any drying by $CO_2$. In order to be able to destroy this insulator without circulation of sodium hydroxide, the solution consists in evaporating all or part of the impregnation solvent of the organogel, which results in the manufacture in situ of a xerogel, thus releasing an empty space all along the casing (annular dimension) as a simple result of the shrinkage due to drying under noncritical conditions of the solvent. A basic solution, for example sodium hydroxide, is then introduced via the top of the annular space, in order to dissolve the silica in situ without having to circulate the basic solution. After these stages, the annular space will then comprise a sodium silicate or potassium silicate brine, depending upon the base used.

It is possible to envisage converting the insulator to a suspension of low viscosity which can be extracted from the confined space by circulation of an appropriate liquid, for example water.

It is also possible to envisage, in order to destroy an insulator formed from an organogel, to circulate through the insulator a base solution, the process comprising an additional prior step of circulating water in order to extract a part of the organic phase from the insulator.

One can also envisage, in order to destroy an insulator formed from an organogel, to circulate through the insulator a base solution, the process comprising an additional prior step of circulating water, pre-heated by passage through a heat exchanger, in order to extract a part of the organic phase from the insulator.

Finally, one can envisage, in order to destroy an insulator formed of an organogel, a step prior to the introduction of a base solution to dissolve the insulator, in which the organogel is dried to convert it into a xerogel.

What is claimed is:

1. A process for destroying a sol-gel type rigid insulator positioned in a confined space, comprising introducing a dissolving basic liquid into the confined space to convert the insulator into a liquid.

2. The process according to claim 1, further comprising neutralizing the liquid.

3. The process according to claim 2, further comprising extracting the liquid from the confined space.

4. The process according to claim 1, further comprising introducing water in the confined space prior to introducing the basic liquid.

5. The process according to claim 1, further comprising recycling the basic liquid which is introduced into the confined space in a closed loop through a heat exchanger.

6. The process according to claim 1, further comprising pressurizing the basic liquid during its introduction into the confined space.

7. The process according to claim 1, further comprising removing the liquid from the confined space and rinsing the confined space with water.

8. A process for destroying a sol-gel type rigid insulator positioned in a confined space, comprising introducing a dissolving basic liquid selected from the group consisting of NaOH, KOH, $NH_4OH$ and solutions or suspensions of $CA(OH)_2$ or $Mg(OH)_2$, into the confined space to convert the insulator into a liquid.

9. A process for removing a sol-gel type rigid insulator from a confined space in an oil well comprising introducing a dissolving basic liquid into the confined space to convert the insulator into a liquid and removing the liquid from the confined space.

10. The process according to claim 9, wherein the basic liquid is introduced into a confined space proximate to a portion of the rigid insulator that is farthest from the surface of the oil well.

11. The process according to claim 10, wherein the basic liquid percolates upward through the rigid insulator after it is introduced into the confined space.

12. The process according to claim 11, wherein the basic liquid is recycled in a closed loop through a heat exchanger and re-introduced into the confined space.

13. The process according to claim 9, further comprising circulating water through the confined space prior to introducing the basic liquid in order to extract a portion of the organic phase from the insulator in the confined space.

14. The process according to claim 9, wherein the basic liquid is selected from the group consisting of NaOH, KOH, $NH_4OH$ and solutions or suspensions of $CA(OH)_2$ or $Mg(OH)_2$.

* * * * *